US007654022B1

(12) United States Patent
Waldsmith et al.

(10) Patent No.: US 7,654,022 B1
(45) Date of Patent: Feb. 2, 2010

(54) ADJUSTABLE SCROLL MOUNTED ON PEDESTAL

(75) Inventors: Allen Waldsmith, Lodi, WI (US); Shane Waldsmith, Juneau, WI (US); Richard McCord, Juneau, WI (US); Loretta McCord, Juneau, WI (US)

(73) Assignee: Bountiful Blessings LLC, Lodi, WI (US)

( * ) Notice: Subject to any disclaimer, the term of this patent is extended or adjusted under 35 U.S.C. 154(b) by 304 days.

(21) Appl. No.: 11/611,669

(22) Filed: Dec. 15, 2006

Related U.S. Application Data

(60) Provisional application No. 60/751,016, filed on Dec. 16, 2005.

(51) Int. Cl.
*G09F 11/18* (2006.01)

(52) U.S. Cl. ..... 40/518; 40/385; 40/604

(58) Field of Classification Search ..... 40/358, 40/518, 604, 607.03; 434/245; D6/300–314
See application file for complete search history.

(56) References Cited

U.S. PATENT DOCUMENTS

| | | | | |
|---|---|---|---|---|
| 656,478 | A | 8/1900 | Schaffer et al. | |
| 669,682 | A * | 3/1901 | Carver | 40/518 |
| 1,595,115 | A | 8/1926 | Myers | |
| 1,760,785 | A | 5/1930 | Sledge et al. | |
| D100,103 | S * | 6/1936 | Helms | D19/1 |
| 2,163,523 | A | 6/1939 | Whitmyre | |
| 2,688,303 | A * | 9/1954 | Leander | 116/173 |
| 3,325,933 | A | 6/1967 | Rizzo et al. | |
| 4,041,626 | A * | 8/1977 | Ellis et al. | 40/518 |
| 4,880,195 | A * | 11/1989 | Lepley | 248/219.4 |
| D355,391 | S * | 2/1995 | Derk | D11/133 |
| 5,605,001 | A | 2/1997 | Derk | |
| 5,924,869 | A | 7/1999 | Haas | |
| 5,942,706 | A * | 8/1999 | Leckie | 84/487 |
| 6,347,600 | B1 * | 2/2002 | Duff, II | 116/209 |
| 6,609,318 | B2 | 8/2003 | Augustine et al. | |
| 7,302,772 | B2 * | 12/2007 | Harrington | 40/725 |
| 7,350,325 | B1 * | 4/2008 | Wang | 40/515 |
| 2002/0189144 | A1 * | 12/2002 | Haggard, Jr. | 40/597 |

* cited by examiner

*Primary Examiner*—Lesley D Morris
*Assistant Examiner*—Christopher E Veraa
(74) *Attorney, Agent, or Firm*—Lathrop & Clark LLP

(57) ABSTRACT

A horizontally-aligned, adjustable scroll including scroll assemblies frictionally and/or mechanically engaging a base pedestal. The scroll also includes a fixed display horizontally-aligned between the scroll assemblies. The scroll is adjustable by moving the scroll assemblies forward and backward to improve positioning of the fixed display.

12 Claims, 3 Drawing Sheets

ADJUSTABLE SCROLL MOUNTED ON PEDESTAL

CROSS-REFERENCE TO RELATED APPLICATION

This application claims the benefit, under 35 U.S.C. Section 119(e), of U.S. Provisional Application Ser. No. 60/751,016, filed Dec. 16, 2005, the entirety of which is expressly incorporated by reference herein.

FIELD OF THE INVENTION

This invention is directed to an adjustable, fixed scroll display.

RELATED ART

U.S. Pat. No. 5,605,001 to Derk discloses a vertically-aligned ornamental scrolling device having a flexible sheet. A stiffening member maintains the indicia-bearing flexible sheet in an outstretched condition between the scroll dowels.

U.S. Pat. No. 5,924,869 to Hass discloses horizontally-aligned, internally-illuminated devotional learning displays for scrolling frames containing text, pictures and the like. The device includes friction producing means, such as an O-ring, mounted on one or both spindles to dampen rotational movement of the spindle thus permitting one-handed operation.

U.S. Pat. No. 5,942,706 to Leckie discloses a collapsible, motorized, rechargeable, horizontally-aligned device for scrolling sheet music such that consecutive pages of music can be viewed.

SUMMARY OF THE INVENTION

One aspect of the invention is to provide a horizontally-aligned scroll for displaying text and/or images. The scroll includes four rods each having crowns attached thereon. The scroll also includes two dowels, each frictionally engaged with two of the four rods. The scroll further includes a display having a planar section having affixed thereon two loop members. Each loop member frictionally engages a dowel, whereby the dowel frictionally engages each rod.

It is another aspect of the invention to provide upper wheels each in abutment between the upper crown and the loop and dowel member. Each rod may run through a hole in each wheel.

It is another aspect of the invention to provide a lower section of the scroll with each crown attached to a bottom end of each rod. The top end of each rod is frictionally attached to a dowel. Two wheels are in abutment between the lower crowns and the bottom ends of the dowels and loops, respectively. Each lower rod also runs through a hole in each lower wheel. Each lower crown includes a ball stop and a setting member.

It is another aspect of the invention to provide a base pedestal having two sockets. The sockets are sized, shaped and dimensioned apart to frictionally and/or mechanically engage the ball stops and setting members of the lower crowns so as to render the scroll adjustable and the display taut.

The present invention advantageously allows the user to adjust the scroll assemblies so that the display is better positioned for the viewer. For example, the display can be positioned more forward or backward relative to the base pedestal to permit a better view.

These and other features and advantages of various exemplary embodiments of systems and methods according to this invention are described in, or are apparent from, the following detailed descriptions of various exemplary embodiments of various devices, structures and/or methods according to this invention.

BRIEF DESCRIPTION OF DRAWINGS

Various exemplary embodiments of the systems and methods according to this invention will be described in detail, with reference to the following figures, wherein.

DETAILED DESCRIPTION OF EXEMPLARY EMBODIMENTS

Figure 1:
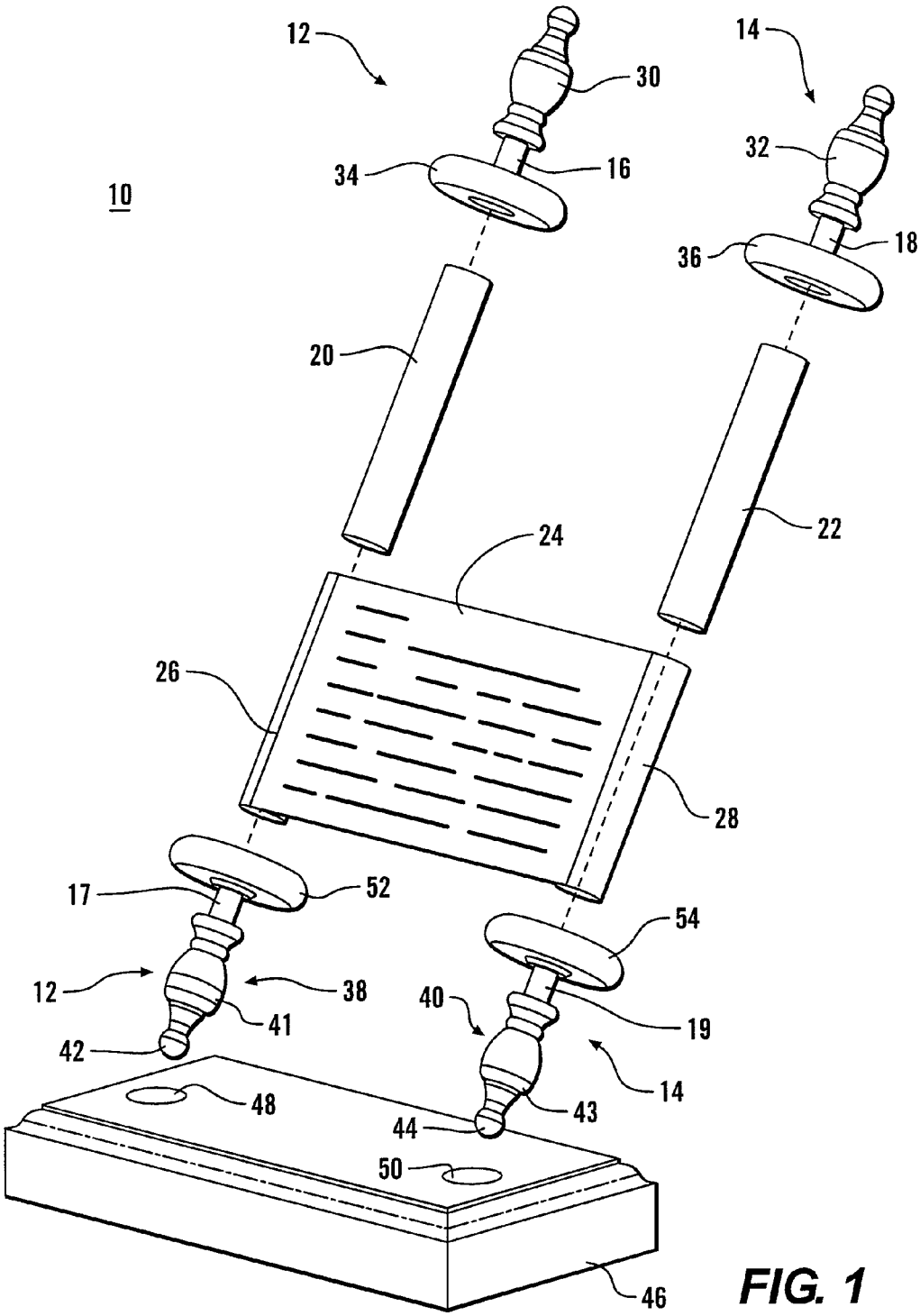
FIG. 1 shows a perspective view of a disassembled, adjustable, fixed, horizontally-aligned scroll in accordance with the present invention.
Figure 2:
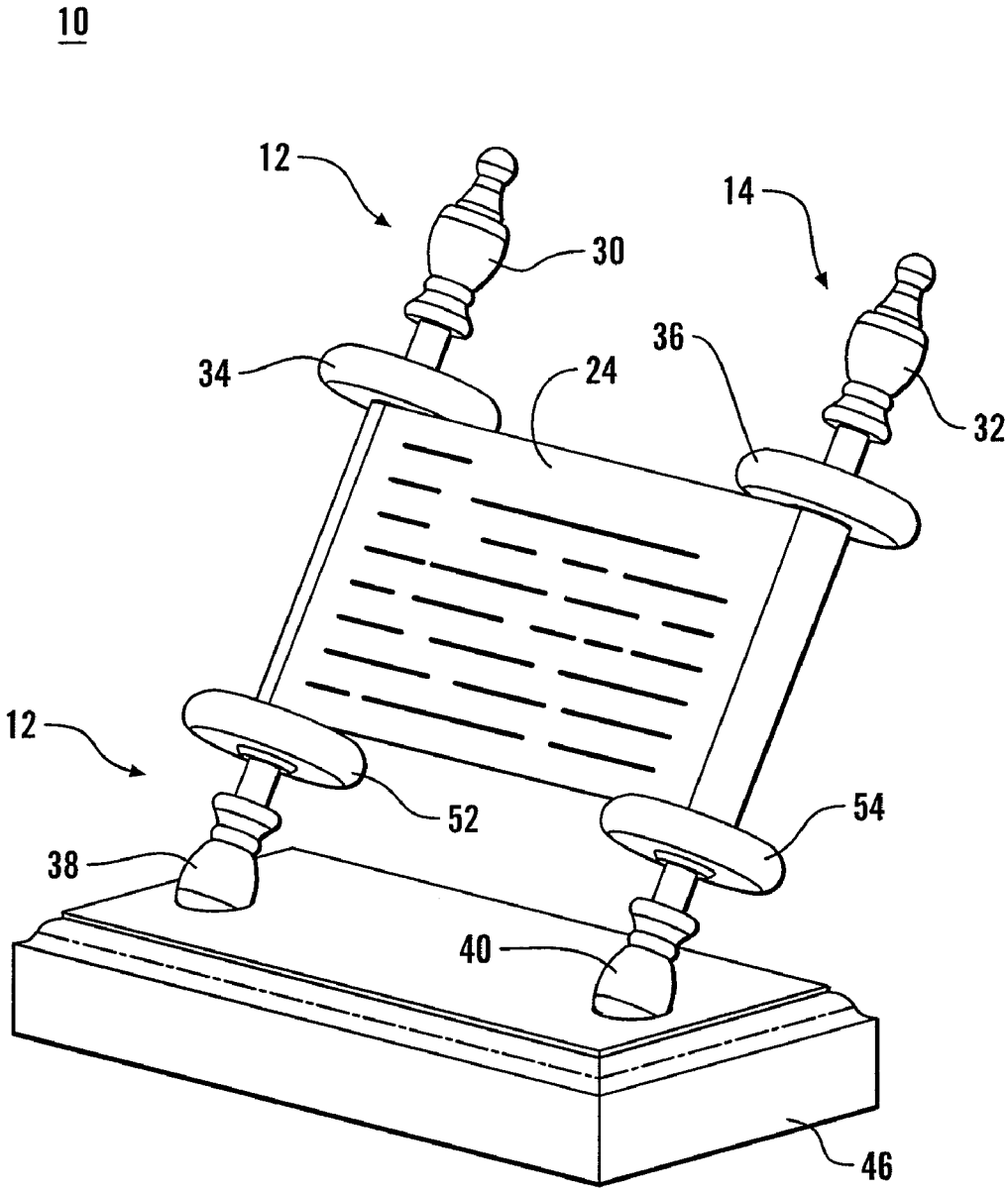
FIG. 2 shows a perspective view of an assembled, adjustable, fixed, horizontally-aligned scroll in accordance with the present invention.

As shown in FIGS. 1 and 2, one embodiment of the present invention is a horizontally-aligned, fixed, adjustable scroll 10. The scroll 10 includes two scroll assemblies 12, 14. Each scroll assembly includes two rods 16, 17 and 18, 19, and each having a hollow dowel 20, 22 circumferentially, longitudinally, and frictionally engaging two of the rods 16, 17, 18, 19, respectively. Alternatively, the dowels and rod ends may be threaded (not shown) to facilitate threaded connections between the rods and the dowels. The scroll 10 also includes a fabric display 24 having two longitudinal loops 26, 28 that slide over the dowels 20, 22. The fabric display 24 may be constructed from a variety of fabric materials known in the art for displaying text such as inspirational, motivational and religious text. The display 24 remains fixed in position relative to the scroll assemblies 12, 14 while it is engaged on the dowels.

The scroll 10 further includes crowns 30, 32 attached to the upper rods 16, 18. Wheels 34, 36 extend around the rods 16,18 and abut the crowns 30, 32 and the loops 26, 28 of the display 24 to retain the fabric display 24 in horizontal alignment on the dowels 20, 22 between the retaining wheels 34, 36. The scroll 10 still further includes lower crowns 38, 40 attached to the bottom end of each lower rod 17, 19. Each crown 38, 40 includes a ball stop 42, 44 and a setting member 41, 43. In one embodiment of the invention the upper crowns 30, 32 are removably frictionally attached to the upper rods 16, 18, to facilitate removal of the crowns and wheels from the upper rods to facilitate changing the fabric display to present a different message or color display, or the like.

Two lower wheels 52, 54 slide over the rods 17, 19 and abut the lower crowns 38, 40 and the loops 26, 28 of the display 24. The scroll 10 still further includes a base pedestal 46 which includes two sockets 48, 50.

As shown in FIG. 2, the assembled, horizontally-aligned, fixed scroll 10 is adjustable forward and backward by virtue of engagement between the ball stops 42, 44 and setting members 41, 43, and the sockets 48, 50 in the base pedestal 46.

As shown in FIG. 2, each scroll assembly 12, 14 can be adjusted forward or backward. Preferably, the scroll 10 is also adjustable from side-to-side to tighten or loosen the fabric display 24 on the dowels 20, 22. The display 24 may be constructed from a fabric, cloth, parchment, paper, plastic or other suitable material. Preferably, the loops 26, 28 are constructed from the same material as the display 24. For example, the display 24 and loops 26, 28 can both be constructed from fabric whereby the loops 26, 28 are formed by stitching the fabric. Alternatively, the display 24 and loops 26, 28 can both be constructed from a suitable plastic material whereby the loops 26, 28 are formed by a seal, such as a heat or UV seal. Preferably, for a pedestal 46 of given shape, size and dimension and sockets 48, 50 of given size, depth, shape and width apart, the display 24 and loops 26, 28 are sized and shaped such that the loops 26, 28 frictionally fit the dowels 20, 22 and such that the display may be taut.

The base pedestal 46 may be constructed from any suitable wood material, including without limitation pine, birch, maple, hickory, walnut and oak. The rods 16, 17, 18, 19 may be constructed from wood, plastic or another suitable material. The wheels 34, 36, 52, 54 may be constructed from the same wood material used to make the pedestal 46, or different material. The dowels 20, 22 are constructed from wood, plastic or another suitable material. The crowns 30, 32, 38, 40 are constructed from metal, wood, plastic or another suitable material. More preferably, the crowns 30, 32, 38, 40 are constructed from brass, chrome-plated brass, the same wood used to make the pedestal 46 and/or the wheels 34, 36, 52, 54, or any other suitable material.

Figure 3:
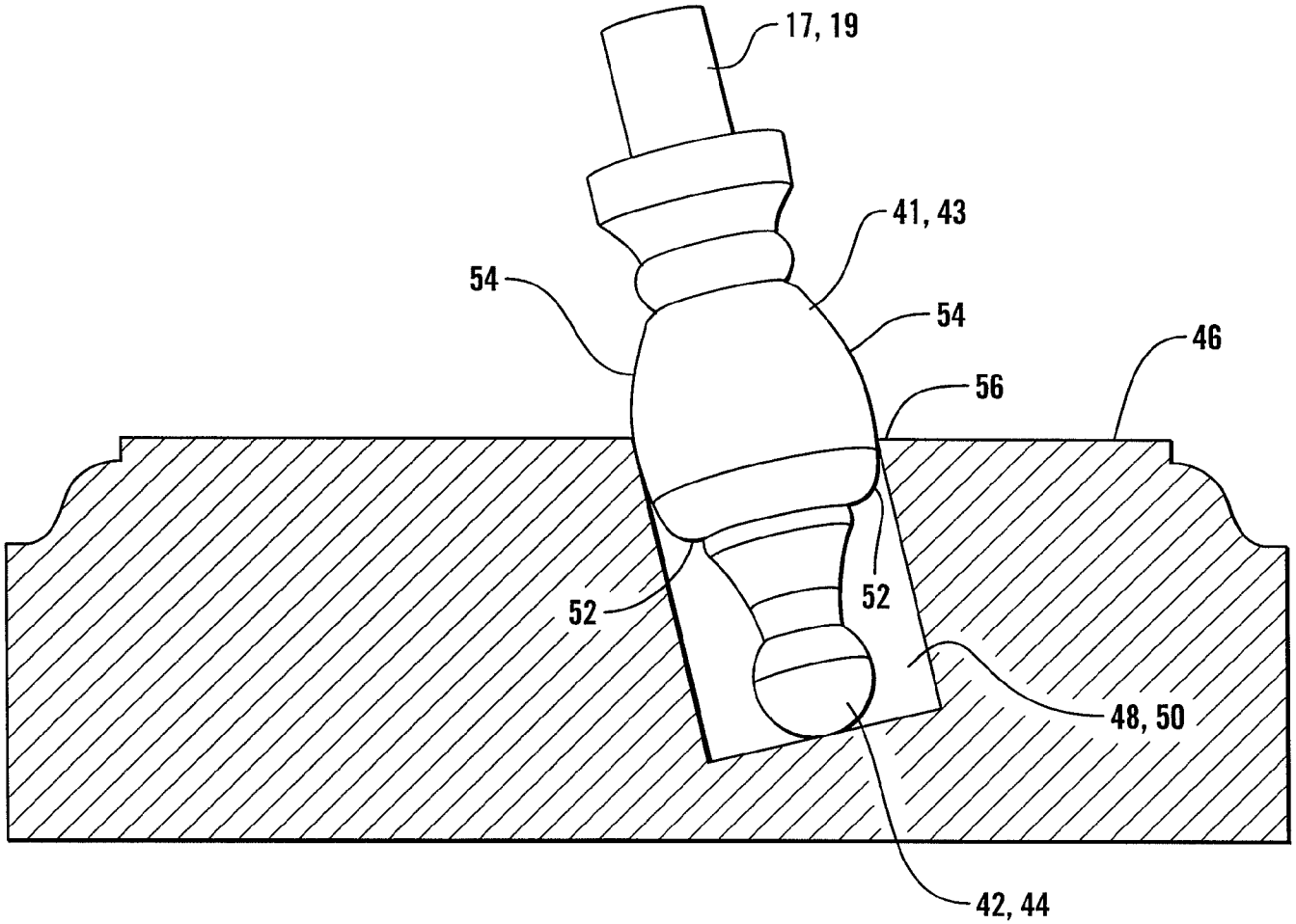
FIG. 3 shows a cross-sectional view of a lower crown in engagement with a socket in the pedestal in accordance with the invention.

As shown in FIG. 3, in one embodiment of the invention, the setting members 41, 43 and ball stops 42, 44 of the lower crown 38, 40 engage the socket 48, 50 of the pedestal 46 in a mechanical and frictional manner. For example, the ball stops 42, 44 engage the bottom of the sockets 48, 50 while the setting members 41, 43 engage the walls and/or top edge 56 of the sockets 48, 50. Engagement between the setting members 41, 43 and the walls and/or top edge 56 of the sockets 48, 50 are frictional as well as mechanical. The ball stops 42, 44 are each engaged against a portion of the bottom of the sockets 48, 50 while the setting members 41, 43 are pressed against the walls and/or top edge 56 of the sockets 48, 50.

Constant frictional and mechanical engagement is accomplished by virtue of the shape and orientation of the curved surfaces 52, 54 on the setting member 41, 43 with respect to the walls and top edge 56. It is seen that as the scroll 10 is adjusted forward and backward (and from side-to-side), the curved surfaces 52, 54 will remain in constant mechanical and frictional engagement with the walls and top edge 56 of the socket 48, 50. It can also be seen that as the lower crown 38, 40 is adjusted within the socket 48, 50, the ball stop 42, 44 remains frictionally and mechanically engaged with the bottom of the socket 48, 50. Thus, as the scroll 10 is adjusted, the ball stops 42, 44 and the curved surfaces 52, 54 of the setting members 41, 43 remain in constant and dynamic mechanical and frictional engagement with the sockets 48, 50.

While this invention has been described in conjunction with the exemplary embodiments outlined above, various alternatives, modifications, variations, improvements and/or substantial equivalents, whether known or presently foreseen, may become apparent to those having at least ordinary skill in the art. Accordingly, the exemplary embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

We claim:

1. An adjustable fixed scroll apparatus for displaying text and/or images comprising:

first, second, third and fourth rods;

first, second, third, and fourth crowns adapted to be attached to said first, second, third, and fourth rods, respectively;

a base pedestal defining first and second sockets each having a substantially cylindrical side wall extending at an inclined angle to the base pedestal and further defining a socket bottom, wherein said first and second sockets are adapted to receive at least said third and fourth crowns;

said third and fourth crowns having first and second ball stops and first and second setting members respectively;

first and second dowels, wherein said first and second dowels are each adapted to be attached to two of said first, second, third, and fourth rods to form first and second scroll assemblies;

a display having a planar member affixed to first and second loop members, wherein said loop members are adapted to be attached to said first and second dowels;

said first and second setting members having curved surfaces which will remain in frictional engagement with the side walls of the sockets when the ball stops are engaged with the bottoms of the sockets to support the scroll assemblies in free-standing adjustable relation to permit forward backward and side-to-side adjustment of the scroll assemblies relative to the base pedestal to permit a better view of the display.

2. The scroll apparatus of claim 1, further comprising: first and second wheels.

3. The scroll apparatus of claim 2, further comprising: third and fourth wheels.

4. The scroll apparatus of claim 3, wherein said first, second, third, and fourth wheels are each adapted to abut one end of one of said first and second dowels, respectively.

5. The scroll apparatus of claim 4, wherein said display is affixed to said first and second loop members and said first and second loop members are adapted to slide over said first and second dowels.

6. The scroll apparatus of claim 1, wherein said first and second dowels are each adapted to be frictionally attached to two of said first, second, third, and fourth rods.

7. The scroll apparatus of claim 1, wherein said display is non-rotationally fixed about said first and second dowels.

8. The scroll apparatus of claim 1, wherein said display is removable from said first and second dowels.

9. The scroll apparatus of claim 1, wherein at least said first and second crowns are removable from said first and second dowels.

10. The scroll apparatus of claim 1, wherein at least said third and fourth crowns are frictionally attached to said third and fourth rods.

11. A scroll apparatus for displaying text and/or images comprising:

first, second, third and fourth rods;

third, and fourth crowns attached to said third, and fourth rods, respectively;

said third and fourth crowns having at least first and second ball stops and at least first and second setting members attached to said third and fourth crowns, respectively;

a base pedestal defining first and second sockets with cylindrical side walls extending downwardly at an inclined angle to the base pedestal and further defining a socket bottom surface, said sockets extending parallel to each other and being adapted to adjustably engage said at least first and second ball stops and said at least first and second setting members, respectively;

first and second dowels, wherein each of said first and second dowels are frictionally attached to two of said first, second, third, and fourth rods, to form first and second scroll assemblies;

a display having a planar member affixed to first and second loop members, wherein said first and second loop members are attached to said first and second dowels;

said first and second setting members each having curved surfaces which are adapted to engage and remain engaged in frictional contact with the side walls of the sockets when the ball stops are engaged against the socket bottom surfaces to permit forward, backward and side-to-side adjustment of the first and second scroll assemblies to optimize the view of the display.

12. The scroll apparatus of claim 11, wherein first and second crowns identical to said third and fourth crowns are attached to said first and second rods, respectively.

* * * * *